US005194228A

United States Patent [19]

Carlson et al.

[11] Patent Number: 5,194,228

[45] Date of Patent: Mar. 16, 1993

[54] FLUIDIZED BED APPARATUS FOR CHEMICALLY TREATING WORKPIECES

[75] Inventors: Roger F. Carlson, Dousman; Jeffrey P. Weiss, Milwaukee, both of Wis.

[73] Assignee: General Signal Corporation, Stamford, Conn.

[21] Appl. No.: 596,997

[22] Filed: Oct. 12, 1990

[51] Int. Cl.[5] ..... B01J 8/18; C21D 1/48

[52] U.S. Cl. ..... 422/143; 422/119; 422/139; 422/198; 148/209; 48/61

[58] Field of Search ..... 148/16, 16.5, 16.6, 148/128, 283; 422/143, 198, 110, 111, 119; 48/61, 127.1, 127.3

[56] References Cited

U.S. PATENT DOCUMENTS

| | | | |
|---|---|---|---|
| 3,303,017 | 2/1967 | Mayer et al. | 75/444 |
| 3,397,875 | 8/1968 | Davis, II | 266/87 |
| 4,028,100 | 6/1977 | Latva | 419/58 |
| 4,279,406 | 7/1981 | Bourhis et al. | 266/81 |
| 4,461,656 | 7/1984 | Ross | 148/16.6 |
| 4,512,821 | 4/1985 | Staffin et al. | 148/16.5 |
| 4,805,881 | 2/1989 | Schultz et al. | 266/257 |
| 4,992,113 | 2/1991 | Baldo et al. | 148/60 |
| 5,039,357 | 8/1991 | Epler et al. | 148/16.6 |

FOREIGN PATENT DOCUMENTS

| | | | |
|---|---|---|---|
| 0024106 | 2/1981 | European Pat. Off. | 148/16.5 |
| 0053675 | 3/1984 | Japan | 148/16.5 |

*Primary Examiner*—Robert J. Warden
*Assistant Examiner*—Christopher Y. Kim
*Attorney, Agent, or Firm*—M. A. Burmeister; R. E. Smiley

[57] ABSTRACT

An endothermic gas generator having separate sources of oxygen and hydrocarbon gas at pressures above the pressure of the endothermic gas to be produced, the sources of oxygen and hydrocarbon gas being interconnected through separate pressure reducing valves and to a gas tight reaction chamber, the reaction chamber containing catalyst bodies and being heated to a temperature sufficient to support a reaction between carbon atoms and oxygen atoms to produce an endothermic gas, the reaction chamber having a outlet port for an endothermic gas resulting from the reaction of the oxygen and the hydrocarbon gases at a pressure approximately that of the mixture of gases entering the reaction chamber.

The outlet port of the endothermic gas generator is directly connected to a plenum chamber at the bottom of a reactor having a perforated plate confronting the plenum chamber and a porous ceramic layer disposed between the perforated plate and a chamber within the reactor, the reactor having a heat source and a bed of heat resistant granules maintained in a fluidized state by the flow of endothermic gas.

7 Claims, 2 Drawing Sheets

FLUIDIZED BED APPARATUS FOR CHEMICALLY TREATING WORKPIECES

The present invention relates to fluidized bed devices for treating a workpiece by subjecting the workpiece to a chemically active gas, particularly an endothermic carbon/oxygen gas. The present invention also relates to generators for endothermicly producing gas containing a combination of hydrogen, nitrogen and carbon monoxide gas.

BACKGROUND OF THE INVENTION

The use of fluidized bed furnaces for treating workpieces with chemically active gases is well known in the art. U.S. Pat. No. 3,749,805 of Karl H. Seelandt entitled FLUID BED FURNACE is an example of such prior art furnaces. In such furnaces, a bed of finely divided solid refractory particles is disposed within a vessel and a gas is directed through the particle bed from the lower portion of the vessel causing the particles to migrate in the manner of a fluid. The workpiece, is suspended in the fluidized bed of solid particles, and an atmosphere of the proper gas to produce the desired chemical reaction is maintained in the bed. In addition, the bed is provided with a source of heat and functions as a heat transfer medium to maintain the temperature of the work piece at a suitable temperature for the desired chemical reaction.

U.S. Pat. No. 4,623,400 of Joseph E. Japka, Robert Staffin and Swarnjeet S. Bhatia entitled Hard Surface Coatings for Metals in Fluidized Beds is an example of the devices of the prior art for treating work pieces in fluidized beds. The reaction vessel of this patent has a horizontal perforated distribution plate adjacent to the bottom thereof which supports a bed of refractory particles, and these particles are maintained in a fluid state by a flow of inert gas into a plenum disposed directly below the distribution plate. A second and chemically active gas is introduced directly into the fluidized bed through a separate conduit.

U.S. Pat. No. 4,512,821 of Robert Staffin, Carol A. Girrell and Mario A. Fonzoni entitled Method for Metal Treatment Using a Fluidized Bed discloses a similar reaction vessel in which a chemically active gas is mixed with an auxiliary gas to provide the flow for fluidization of the bed and establishes the proper gas atmosphere within the reaction vessel. U.S. Pat. No. 4,461,656 of John A. Rose entitled Low Temperature Hardening of the Surface of a Ferrous Metal Workpiece in a Fluidized Bed Furnace also fluidizes a bed of refractory particles with a mixture of chemically active and inert gases.

Carburizing is one of the processes conventionally carried out in a fluidized bed furnace. In one carburizing process, hydrocarbon bearing gases are introduced with a suitable inert carrier gas into the fluidized bed. This process has proven to be unreliable and unrepeatable, and produces excessive free carbon, or soot, rather than the carbon monoxide necessary for a reliable process.

An endothermic gas generator produces a carbon-/oxygen containing gas suitable for the carburization process. In this reaction, a hydrocarbon containing gas, such as natural gas which generally contains $CH_4$, is combined with air while supplying heat, according to the following formula:

$$0.29CH_4\ (gas)+0.71\ air=0.29CO\ (gas)+0.56H_2+0.56N_2,$$

and produces reaction products in volumetric proportion as follows:

| | |
|---|---|
| Carbon Monoxide (CO) | 20% |
| Hydrogen ($H_2$) | 39% |
| Nitrogen ($N_2$) | 40% |
| Water Vapor | <1% |
| Carbon Dioxide ($CO_2$) | Trace |
| Oxygen ($O_2$) | Trace |

Endothermic gas is stable and suitable for the carburizing process, but endothermic gas generators produce gas at around atmospheric pressure, thereby requiring pressurizing of the gas or the use of an auxiliary gas booster before it can be used in a fluidized bed reactor.

The use of an inert gas plus methane for carburizing is not desirable because insufficient carbon monoxide is generated to allow the carburizing process to take place. The methane breaks down to basically solid carbon and this diffuses into the steel. This is a very slow and unreliable process. Experiments have shown that if an activator such as barium carbonate is added to a fluid bed, using an inert gas plus methane, the carburizing process increases in speed and uniformity. This is the result of carbon monoxide from the activator being generated. This is well known to those skilled in the art of pack or solid carburizing.

Endothermic gas contains the carbon monoxide necessary for carburizing and additions of methane react with the water vapor and carbon dioxide present to allow the carburizing process to occur. Water vapor and carbon dioxide are decarburizers to the steel and hence must be lowered before a sufficient carbon potential will occur so carburizing will take place. It is therefore an object of the present invention to provide a gas generator capable of producing a sufficient flow of gas at a sufficient pressure to make it unnecessary to utilize an inert gas for fluidization of the bed of the furnace.

It is an object of the present invention to provide an endothermic gas generator which will produce a sufficient flow of gasses at a sufficient pressure, including carbon/oxygen bearing gasses, to directly fluidize the bed of a fluidized bed furnace.

The prior art teaches the use of gas pressure boosters, carburetors, mixers or blenders between and/on an endothermic gas generator and a fluidized bed furnace in order to provide sufficient gas pressure to fluidize the bed of the furnace. Such components increase the cost of a combination endothermic gas generator and fluidized bed furnace. Therefore, it is an object of the invention to provide a combination endothermic gas generator and fluidized bed furnace which does not require a gas pressure booster, carburetor, mixer or blender; and which reduces the cost of a combination endothermic gas generator and fluidized bed furnace.

SUMMARY OF THE INVENTION

The present invention provides a combination gas generator and fluidized bed furnace for treating a workpiece with carbon/oxygen containing gases in which an elongated reaction vessel has an inlet port at one end and an opening at the other end thereof to exhaust gasses from the vessel. The vessel also may use the port to provide access to the vessel for the introduction of a workpiece to be treated. The reaction vessel is provided with a plenum chamber at the one end of the vessel which communicates with the inlet port, and the plenum chamber has a perforated distribution plate disposed between the plenum chamber and the interior portion of the reaction vessel and spaced from the one end of the vessel. The reaction vessel contains a porous body of thermal insulating material disposed within the vessel and abutting the distribution plate, and a bed of refractory particles or granules is disposed within the vessel between the body of porous insulating material and the opening of the vessel. Generally, the vessel is mounted vertically with the one end at the bottom and the other end at the top to utilize gravitational forces. The reaction vessel also is provided with means for heating the vessel to a temperature facilitating a chemical reaction between the gas flowing through the vessel and a workpiece immersed within the bed of refractory particles.

An endothermic gas generator and a hydrocarbon gas outlet is connected to the inlet port of the reaction vessel. The gas generator has a source of oxygen at a pressure above the pressure of the endothermic gas to be employed in the reaction vessel and a first pressure reduction valve with an inlet connected to the source of oxygen and an outlet. The gas generator also has a source of hydrocarbon gas at a pressure above the pressure of the endothermic gas to be employed in the reaction vessel and a second pressure reduction valve having an inlet connected to the source of hydrocarbon gas and an outlet. The outlets of the first and second pressure reduction valves are interconnected and the interconnecting means is connected to the inlet of a retort. An adjustable valve is connected in series with the second pressure reduction valve, and the adjustable valve is controlled by a transducer responsive to the carbon concentration in the gas at the outlet opening of the retort. The retort forms a gas tight reaction chamber, and a plurality of bodies of material forming a catalyst to a reaction between the carbon atoms from the hydrocarbon gas source and the oxygen atoms from the source of oxygen are disposed within the reaction chamber. The generator has a heater for heating the gas in the reaction chamber to support the reaction between the carbon atoms from the hydrocarbon gas source and the oxygen atoms from the source of oxygen, the gas evolving from an outlet port of the retort being of sufficient volume and pressure to fluidize the granules in the vessel of the fluidized bed furnace. A small amount of approximately 10% by volume of a hydrocarbon gas is added to the output of the generator before the gas enters the fluid bed furnace.

Both the endothermic gas generator and the fluidized bed furnace are unique and particularly adapted to function together. In a preferred construction, the reaction chamber of the endothermic gas generator has a central elongated thermally conducting tube extending from the inlet port toward the other end of the chamber, and the plurality of catalytic bodies are disposed in the retort about the tube. Accordingly, the gas in the tube is preheated before impinging upon the bodies of catalytic material to permit more efficient use of the catalytic bed and allow the heat generated by the chemical reaction to occur at the bottom of the retort so as to avoid excessive internal retort temperatures.

DESCRIPTION OF THE DRAWINGS

For a more complete description of the invention, reference is made to the drawings, in which.

DESCRIPTION OF THE PREFERRED EMBODIMENTS

Figure 1:
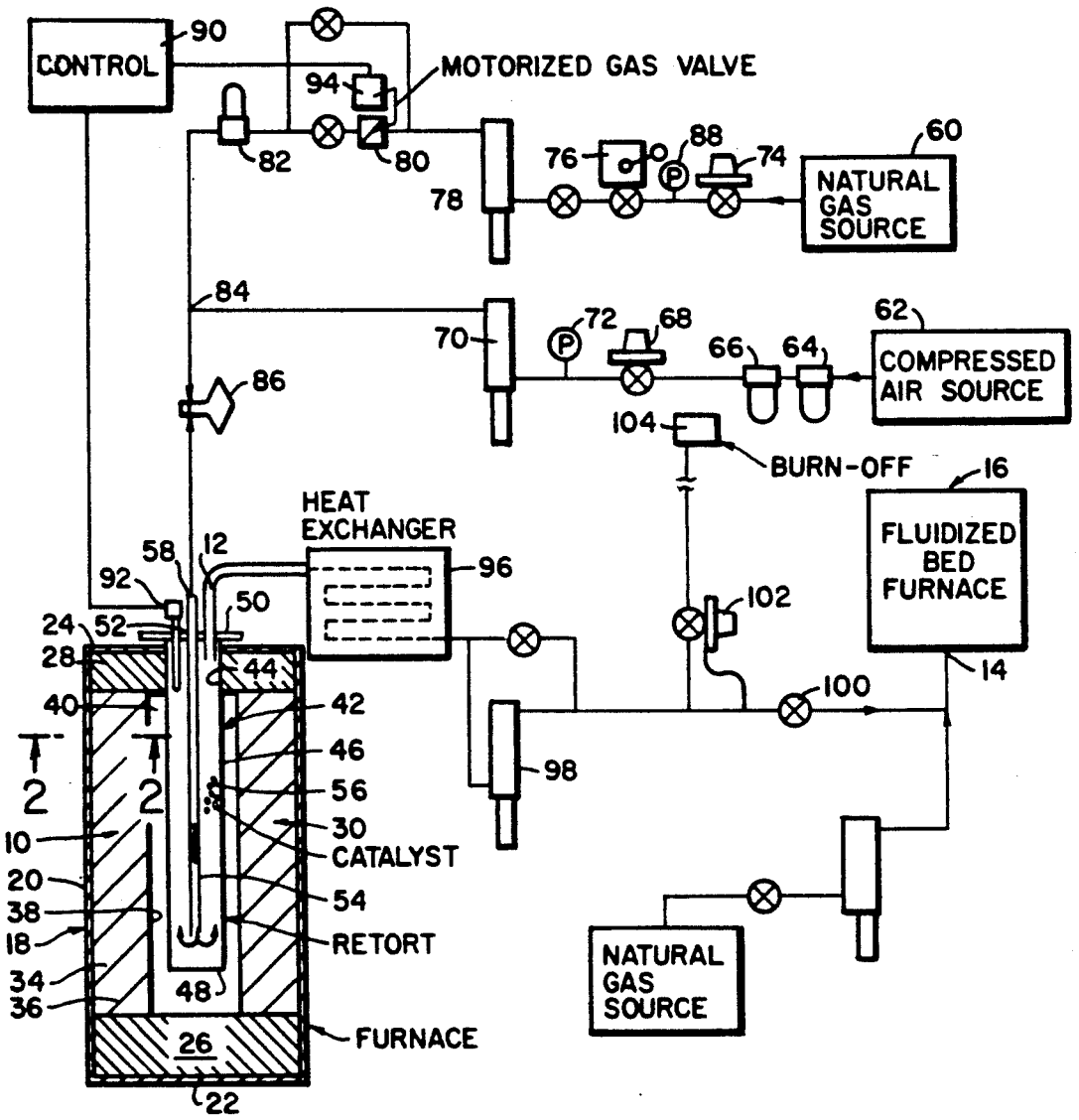
FIG. 1 is a view of an endothermic gas generator coupled to a fluidized bed furnace constructed according to the present invention, the view being schematical except for the gas generator which is shown in vertical section.
Figure 2:
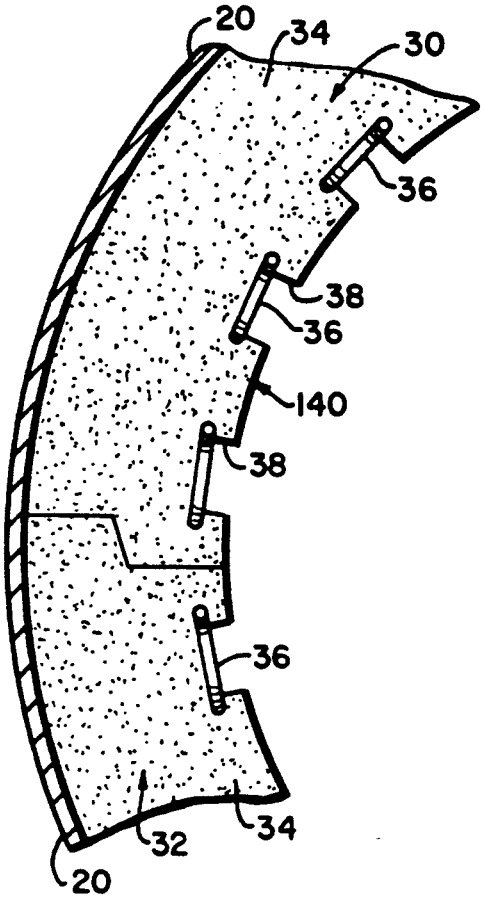
FIG. 2 is a fragmentary sectional view of the endothermic gas generator taken along the line 2—2 of FIG. 1.

FIG. 1 illustrates an endothermic gas generator 10 with an outlet port 12 connected to the gas input orifice 14 of a fluidized bed furnace 16. The gas generator 10 has an exterior casing 18 with a cylindrical side wall 20, a flat circular bottom 22 and a flat circular top 24. The casing 18 supports a layer 26 of thermal insulation on the interior side of the bottom 22 and a second layer 28 of thermal insulation on the interior side of the top 24. A third cylindrical layer of thermal heating units 30 extends between the layers 26 and 28 of thermal insulating material at the bottom and top of the casing 18. The thermal heating units 30 are illustrated in FIG. 2 and consist of blocks 32 of thermal insulating material 34 and electrical heating elements 36. The thermal insulating material 34 in each of the blocks 32 is a mass of ceramic fibers packed together to form a solid body, and the electrically conducting heating element 36 is mounted on the mass of fibers confronting the axis of the side wall 20. Reference is made to U.S. Pat. No. 4,575,619 of Ludwig Porzky issued Mar. 11, 1986 for a more detailed description of the combination thermal insulating and heating units utilized as blocks 32. In a preferred construction of the blocks 32, each of the blocks 32 is provided with a slot 38 confronting the central axis of the casing 18, and the heating element 36 is embeded within the mass 34 of ceramic fibers at the base of the slot 38.

The layers 26, 28 and 30 form a cylindrical cavity 40 on the central axis of the casing 18. A cylindrical retort 42 is mounted within the cavity 40 coaxial with the casing 18, and the retort 40 extends through an opening 44 in the upper layer 28 of insulation and through the top 24 of the casing 18. The retort 42 has a cylindrical outer wall 46, and a flat bottom 48 is sealed on the wall 46 at the lower end thereof. The retort 42 has a flat circular plate 50 disposed exteriorly of the casing 18 and sealed on the upper end of the cylindrical wall 46. The interior of the retort 42 is sealed from the atmosphere except for openings in the plate 50. The wall 46 and bottom 48 of the retort 42 are constructed of thermally conducting material which is capable of withstanding the temperature necessary to carry out the reaction within the retort 42, namely 1800 degrees Fahrenheit. Nickel alloy steel has been found to be a suitable material for the wall 46 and bottom 48 of the retort 42.

The plate 50 is provided with the outlet port 12 of the gas generator 10 adjacent to the wall 46 of the retort 42. The plate 50 also has an aperture 52 coaxial with the cylindrical wall 46 of the retort 42, and a straight hollow tube 54 is sealed within the aperture 52 and extends into the retort 42 coaxial with the wall 46. The end of the tube 54 opposite the plate 50 terminates adjacent to and spaced from the bottom 48 of the retort 42. The space between the tube 54 and the wall 46 of the retort, and the tube 54 and the bottom 48 of the retort, is packed with small bodies 56 of a catalyst for facilitating the desired chemical reaction within the retort 42. The bodies 56 are conventionally cubes of porous ceramic impregnated with nickel salt, and these bodies form a preferred catalyst for producing endothermic gas from natural gas and oxygen.

The end of the tube 54 adjacent to the plate 50, designated 58, forms the inlet to the retort, and the inlet 58 is connected to a source of natural gas 60 and a source of compressed air 62. The natural gas source 60 is preferably conventional natural heating gas which contains $CH_4$, but may be any other source of hydrocarbon gases or liquids. The compressed air source 62 may be generated in any manner, such as a conventional plant source of compressed air.

The compressed air source 62 is connected through filters 64 and 66 which remove moisture from the compressed air, an adjustable pressure regulator 68, and a volume regulator 70. A pressure gauge 72 is connected between the pressure regulator 68 and volume regulator 70 to facilitate adjustment of the system.

The natural gas source 60 is connected through an adjustable pressure regulator 74, a manually adjustable valve 76, a volume regulator 78, a motorized gas valve 80, and a filter 82 to a junction 84 with the compressed air from the regulator 70, and the natural gas and compressed air are mixed at the junction 84. The mixture of compressed air and natural gas flows from the junction 84 through a fire check valve 86 to the inlet 58 of the tube 54. A pressure gauge 88 connected between the pressure regulator 74 and the manually adjustable valve 76 facilitates adjustment of the system.

The mixture of natural gas and compressed air entering the retort 42 is controlled by a servo controller 90 which monitors the carbon dioxide in the retort 42 by means of a transducer 92 mounted on the plate 50 and extending into the retort 42. The transducer 92 may be of the type disclosed in U.S. Pat. No. 4,606,807 granted Aug. 16, 1986 to Donald H. Mendenhall entitled Probe For Measuring The Carbon Potential Of Endothermic Gas. The response of the transducer 92 is compared with a standard in the controller 90, as is conventional, and an error signal is generated by the controller. The error signal is connected to a servo motor 94 which is mechanically linked to the valve 80. The servo motor 94 drives the valve 80 to adjust the flow of natural gas to the junction 84 to optimize the production of carbon monoxide in the gas generator 10.

Endothermic carbon/oxygen gas from the outlet port 12 flows through a heat exchanger 96 to cool the gas to increase the stability of the gas. From the heat exchanger 96, the gas flows through a volume regulator 98 and a valve 100 to the inlet orifice 14 of the fluidized bed furnace 16. A portion of the gas from the regulator 98 flows through a pressure regulator 102 to a burn-off 104, thereby maintaining a relatively constant pressure at the inlet port 14 of the fluidized bed furnace 16.

Figure 3:
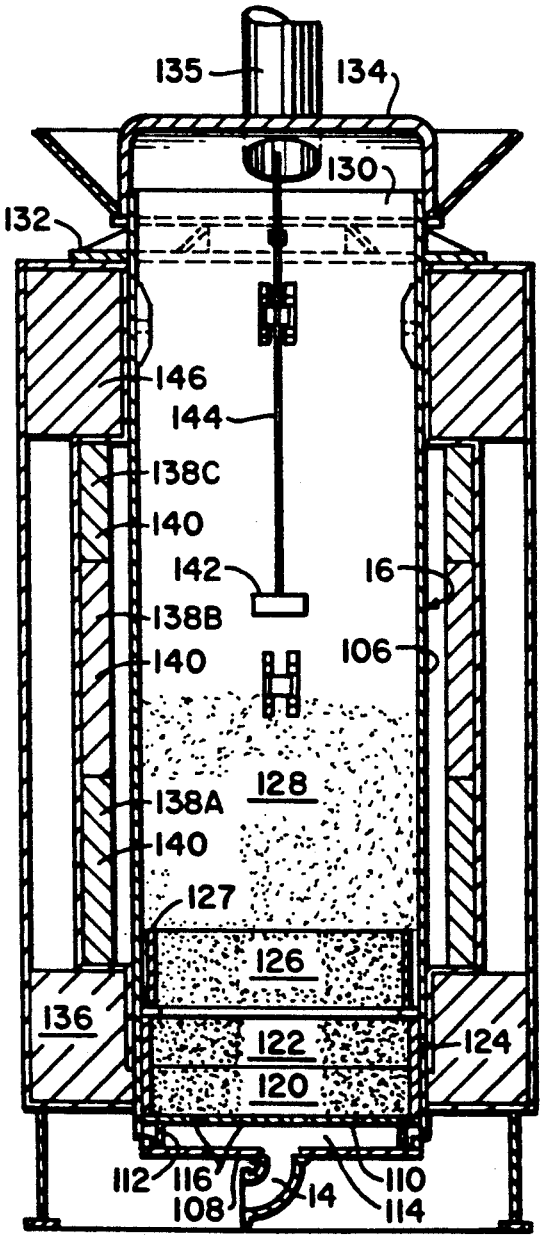
FIG. 3 is a vertical sectional view of a preferred construction of the fluidized bed furnace illustrated in FIG. 1, the view being on the central axis of the furnace.

The fluidized bed furnace 16 is illustrated in FIG. 3. The fluidized bed furnace 16 has an elongated cylindrical shell 106 constructed of metal capable of withstanding prolonged periods of use at the elevated temperatures of operation of the fluidized bed furnace, such as nickel alloy steel. The shell 106 is disposed vertically and has a flat bottom 108 with the inlet orifice 14 disposed centrally thereof. A perforated distribution plate 110 is mounted and sealed against gas leakage on a cylindrical collar 112 which extends to the bottom 108 of the shell 106, and the distribution plate 110 is disposed normal to the axis of the shell. The collar 112 is sealed against gas leakage to the bottom 108 to form a plenum chamber 114 between the bottom 108 and the distribution plate 110. The distribution plate 110 is provided with a plurality of apertures 116 to permit the passage of gasses from the plenum chamber 114 into the shell 106.

A first flat porous ceramic disc 120 and a second flat porous ceramic disc 122 are stacked on the side of the distribution plate 110 opposite the plenum chamber 114. A gas tight collar 124 surrounds the first and second ceramic discs 120 and 122. The first ceramic disc 120 is more porous than the second ceramic disc 122, so that the second ceramic disc 122 provides the greatest resistance to gas flow in the system. The distribution plate 110 provides a rough equalization of gas flow across the plane of the shell 106 in that it equalizes the flow though a plurality of spaced locations, and the first and second porous ceramic discs 120 and 122 further equalize the flow of gas across the plane of the shell 106 by blending the locations of the distribution plate 110 into substantially a single gas entry to the interior of the shell 106.

A load support 126 is mounted on the collar 124 above the second porous disc 122, and the load support has a cylindrical wall 127 which extends upwardly within the shell 106. A mass 128 of fine refractory granules is disposed in the load support 126, and these granules form the bed which becomes fluidized by the flow of gas through the shell 106.

A small quantity of a granular activator can be mixed within the refractory granulars to enhance the carburization process if an inert fluidizing gas is used in place of the endothermic gas. Granules of barium carbonate in a quantity equal to 10% by weight of the refractory granules has proven effective to accelerate the carburization process. The barium carbonate is used up in the process leaving only the refractory granules in the mass 128.

The upper end of the shell 106 is open, the opening being designated 130 in FIG. 3, and exhaust gases from the shell 106 exit through the opening 130. A circular hood 132 is mounted on the exterior surface of the shell 106 adjacent to the opening 130 to form a protective surface for a cover 134 which surrounds and is spaced from the outer surface of the shell 106 and is provided with a vent pipe 135.

A cylindrical layer 136 of thermal insulation is disposed on the outer surface of the portion of the shell 106 which confronts the second porous disc 122 and the lower part of the load support 126 to permit the relatively cool gas to begin to warm. Three cylindrical bands 138A, 138B and 138C of thermal heating units 140 extend upwardly from the layer 136 of insulation material. The thermal heating units 140 are constructed in the same manner as the heating units 30 illustrated in FIG. 2. The three bands 138A, 138B and 138C are provided to supply different amounts of heat to support the reaction being carried on within the shell 106. The work piece, designated 142, is lowered through the opening of the shell 106 into the fluidized bed on a cable 144 by means not shown. Heat need not be supplied to the shell 106 in the region adjacent to the opening 130, and a layer 146 of thermal insulation surrounds the shell 106 between the opening 130 and the upper band 138C.

Those skilled in the art will devise alternative uses and modifications for the invention here set forth in addition to those described herein. Therefore, it is intended that the scope of this invention be limited not by the foregoing disclosure, but only by the appended claims.

The invention claimed is:

1. A combination fluidized bed reactor and endothermic generator comprising, a fluid tight reaction vessel, said reaction vessel having a central axis of elongation and a top end and a bottom end, said reaction vessel being vertically disposed, means defining a plenum chamber mounted in fluid tight engagement on the reaction vessel at the bottom end thereof, said plenum chamber means having a base plate with means defining an inlet orifice disposed at the bottom end of the reaction vessel, a collar having one end mounted on the base plate, and a flat top plate mounted on the collar and disposed normal to the axis of elongation of the reaction vessel, the base plate, collar and top plate being sealed to each other against fluid leakage, and the top plate having means defining a plurality of apertures for distributing gas evolving from the plenum chamber, a porous ceramic layer having parallel opposite sides disposed with one side abutting the top plate of the plenum chamber means and extending across the reaction vessel, a bed of heat resistant granules and granulated activator disposed within the reaction vessel between the porous ceramic layer and the top of the reaction vessel, means disposed exteriorly of the reaction vessel for heating the granules in the reaction vessel to establish and maintain a reaction temperature with the reaction vessel, and means for providing a source of endothermic gas connected to the plenum chamber, an endothermic gas generator disposed external to said fluidized bed reactor and having means for providing a source of oxygen at a pressure above the pressure of the endothermic gas to be produced by the generator, a first pressure reduction valve having an inlet connected to the means for providing a source of oxygen and an outlet, means for providing a source of hydrocarbon gas at a pressure above the pressure of the endothermic gas to be produced by the generator, a second pressure reduction valve having an inlet connected to the source of hydrocarbon gas, means having an outlet opening interconnecting the outlets of the first and second pressure reduction valves including an adjustable valve connected between the outlet of the second pressure reduction valve and the opening of the interconnecting means, means responsive to the carbon concentration in the gas at the outlet opening of the interconnecting means for adjusting the adjustable valve, a furnace having a gas tight reaction chamber therein, the chamber having an inlet port connected to the outlet opening of the interconnecting means, and an outlet port being connected to the inlet orifice of the plenum chamber means of the reaction vessel, a plurality of bodies of material forming a catalyst to the reaction between carbon atoms from the gas from the hydrocarbon gas source and the oxygen atoms from the gas from the source of oxygen disposed within the reaction chamber, and the furnace having means to heat the gas from the hydrocarbon gas source and from the oxygen gas source in the reaction chamber to support the reaction between carbon atoms from the gas from the hydrocarbon gas source and the oxygen atoms from the gas from the source of oxygen, and the pressure of the endothermic gas from the endothermic gas generator being sufficient to fluidize the bed of granules in the reaction vessel.

2. The combination fluidized bed reaction and endothermic generator of claim 1 further comprising a heat exchanger having a first fluid conduction path with an inlet orifice connected to the outlet port of the chamber and an outlet port, said heat exchanger having a second fluid conduction path with an inlet orifice and an outlet orifice, said second conduction path being connected to a source of fluid at a temperature substantially lower than the temperature of the gas evolving from the outlet port of the chamber.

3. The combination fluidized bed reactor and endothermic generator of claim 1 further comprising a pressure regulator connected to the outlet port of the plenum chamber.

4. A combination endothermic gas generator and fluidized bed furnace for treating a workpiece with a carbon/oxygen gas comprising, in combination, an elongated vessel constructed of thermally conducting materials with the axis of elongation of the vessel vertically disposed and extending between an upper end and a lower end of the vessel, the vessel having an inlet port at the lower end thereof, the vessel having an opening at the upper end thereof to provide access to the vessel for the introduction of a workpiece to be treated, means to close the opening in the vessel including a removable cover, means defining the plenum chamber disposed within and at the lower end of the vessel communicating with the inlet port, said plenum chamber means having a perforated distribution plate disposed normal to the longitudinal axis of the vessel and spaced from the lower end of the vessel, a body of porous thermal insulating material having spaced parallel opposite sides disposed within the vessel, one of the sides thereof abutting the distribution plate, a bed of refractory particles disposed within the vessel between the other side of the body of porous insulating material and the opening of the vessel, and means exterior of the vessel for heating the vessel to a temperature facilitating a chemical reaction between the gas flowing through the vessel and the workpiece, and an endothermic gas generator disposed external to said fluidized bed furnace and comprising means for producing a source of oxygen at a pressure above the pressure of the endothermic gas to be produced by the generator, a first pressure reduction valve having an inlet connected to the means for providing a source of oxygen and an outlet, means for providing a source of hydrocarbon gas at a pressure above the pressure of the endothermic gas to be produced by the generator, a second pressure reduction valve having an inlet connected to the means for providing a source of hydrocarbon gas, means having an outlet opening interconnecting the outlets of the first and second pressure reduction valves including an adjustable valve connected between the outlet of the second pressure reduction valve and the opening of the interconnecting means, means responsive to the carbon concentration in the gas at the outlet opening of the interconnecting means for adjusting the adjustable valve, a furnace having a gas tight reaction chamber therein, the chamber having an inlet port connected to the outlet opening of the interconnecting means and an outlet port, a plurality of bodies of material forming a catalyst to a reaction between carbon atoms from the hydrocarbon gas source and the oxygen atoms from the source of oxygen disposed within the reaction chamber, and the furnace having means to heat the gas in the reaction chamber to support the reaction between the carbon atoms from the hydrocarbon gas source and the oxygen atoms from the source of oxygen, the gas evolving from the outlet port of the gas generator being a sufficient volume and pressure to fluidize the granules in the vessel of the fluidized bed furnace.

5. The combination gas generator and fluidized bed furnace for treating a workpiece with a carbon/oxygen gas of claim 4, wherein the reaction chamber has a central axis of elongation extending between opposite ends, the inlet and outlet ports being disposed at one end of the chamber and the chamber being provided with a central elongated thermally conducting tube extending from the inlet port toward the other end of the chamber and terminating at a location spaced from and adjacent to the other end of the chamber, the plurality of bodies of material forming a catalyst to a reaction between carbon atoms from the hydrocarbon gas source and the oxygen atoms from the source of oxygen being disposed about the tube, whereby the gas in the tube is preheated before impinging upon the bodies of catalytic material.

6. The combination gas generator and fluidized bed furnace for treating a workpiece with a carbon/oxygen gas or liquids of claim 5, wherein the cross sectional area of the tube is substantially less than the cross sectional area of that portion of the chamber disposed exterior of the tube.

7. The combination gas generator and fluidized bed furnace for treating a workpiece with a carbon/oxygen gas of claim 6 wherein the perforated plate of the plenum chamber and the porous bodies form means for restricting the flow of gas, whereby the flow rates of the gas at the inlet and outlet ports of the reaction chamber are substantially the same and the residence time of the gas in the tube is substantially less than the residence time of the gas in that portion of the reaction chamber exterior of the tube.

* * * * *